US011529710B2

(12) United States Patent
Kedziora

(10) Patent No.: US 11,529,710 B2
(45) Date of Patent: Dec. 20, 2022

(54) CUTTING TOOL SHARPENING FIXTURE AND METHOD OF USE

(71) Applicant: Woodpeckers, LLC, Strongsville, OH (US)

(72) Inventor: Matthew D Kedziora, Seven Hills, OH (US)

(73) Assignee: Woodpeckers, LLC, Strongsville, OH (US)

( * ) Notice: Subject to any disclaimer, the term of this patent is extended or adjusted under 35 U.S.C. 154(b) by 440 days.

(21) Appl. No.: 16/738,280

(22) Filed: Jan. 9, 2020

(65) Prior Publication Data

US 2021/0213582 A1 Jul. 15, 2021

(51) Int. Cl.
*B24B 3/54* (2006.01)

(52) U.S. Cl.
CPC ..... *B24B 3/54* (2013.01)

(58) Field of Classification Search
CPC ..... B24B 3/54; B24B 3/60; B24B 41/066; B24B 15/06
See application file for complete search history.

(56) References Cited

U.S. PATENT DOCUMENTS 686,891 A * 11/1901 Dunbar ..... B25D 5/02 33/428
2,740,241 A * 4/1956 McCubbin ..... B24B 41/066 451/371
4,733,501 A 3/1988 McLean
7,281,969 B2 10/2007 Naples et al.
8,388,413 B1 * 3/2013 Dovel ..... B24D 15/06 451/45
2005/0139056 A1 * 6/2005 Gass ..... B27B 27/02 83/438
2005/0246906 A1 * 11/2005 Greene ..... B26B 21/40 30/526
2016/0121448 A1 * 5/2016 Huang ..... B24B 3/60 451/369

* cited by examiner

*Primary Examiner* — Nhat Chieu Q Do
(74) *Attorney, Agent, or Firm* — Sand, Sebolt & Wernow Co., LPA

(57) ABSTRACT

A cutting tool sharpening fixture system and method of use is provided. More particularly, the cutting tool has a sharpening guide that is supportable at two points while sharpening and the cutting tool has an angle fixture. The angle fixture has a fence that is movable along a track channel to set an angle. The sharpening guide with wheels on two body portions are removable from the angle fixture.

12 Claims, 18 Drawing Sheets

CUTTING TOOL SHARPENING FIXTURE AND METHOD OF USE

BACKGROUND

Technical Field

The present disclosure relates generally to a cutting tool sharpening fixture and method of use. More particularly, the present disclosure relates to a sharpening guide supportable at two points while sharpening is occurring and an angle fixture to set a desired angle. Specifically, the present disclosure relates to an angle fixture with a fence movable along a track channel to set an angle and a sharpening guide with removable wheels on two body portions.

Background Information

Cutting tools are used in a variety of applications in order to cut, shave, contour, and shape or otherwise remove various materials from a work piece. Many of these cutting tools have sharp blades. These cutting tools may include, but are not limited to, chisels, scissors, knives, blades, saws, and other sharp edges. However, after extended use, the cutting tool's edge may become dull over time. Instead of potentially replacing the tool, one may instead desire to sharpen the tool in order to restore the cutting edge to a greater level of sharpness as a means to save cost. A wide variety of sharpening techniques are known. However, in many of these sharpening techniques, it is difficult to precisely define the opposing surfaces and sharpen the desired edge of the original blade in order to precisely define a cutting edge.

SUMMARY

Thus, cutting tool sharpening devices can benefit from improvement. In one aspect, an exemplary embodiment of the present disclosure may provide a system for refining an edge of a tool comprising: a guide, the guide has two body portions, said guide comprising, a first interior side on a first body portion opposed by a second interior side on a second body portion operative to apply a force to a tool desired to be refined, at least one wheel on the first body portion, at least one wheel on the second body portion; wherein the at least one wheel on the first body portion and the at least one wheel on the second body portion are operative to support the tool while being refined, and an angle fixture, the angle fixture has a body, with a track channel on a top side of the angle fixture and said angle fixture comprising, a fence operative to move along the track channel, at least one angle aperture, and at least one pin operative to nest in the angle aperture to set an angle to refine an edge of the tool. This exemplary embodiment or another may provide the at least one wheel on the first body portion is located on the first interior side and the at least one wheel on the second body portion is located on the second interior side. This exemplary embodiment or another may provide the at least one wheel on the first body portion is located on an exterior side of the first body portion and the at least one wheel on the second body portion is located on an exterior side of the second body portion. This exemplary embodiment or another may provide the at least one wheel on the first body portion and the at least one wheel on the second body portion wheels are selectively disengagable between the first interior side and a first exterior side and the second interior side and a second interior side, respectively. This exemplary embodiment or another may provide the tool is supported by at least two points. This exemplary embodiment or another may provide a securing mechanism operative to secure the fence to the angle fixture. This exemplary embodiment or another may provide a rotatable screw in connection with the first interior side and second interior side operative to adjust a distance between the first interior side and second interior side by rotating. This exemplary embodiment or another may provide at least one post, said post operative to be inserted into at least one aperture on the first interior side and second interior side. This exemplary embodiment or another may provide an angle gauge operative to check angles of an edge of a tool.

In another aspect, an exemplary embodiment of the present disclosure may provide a method for preparing a tool to be refined comprising: setting an angle on an angle fixture, placing a guide onto the angle fixture, inserting a cutting tool within the guide, abutting a cutting edge of the cutting tool with a side of a fence engaged with the angle fixture, and securing the cutting tool to the guide. This exemplary embodiment or another may provide where setting comprises: disengaging a lock knob on the fence to permit the fence to move about the angle fixture, removing a pin engaged with the fence, choosing an angle to set the guide, placing the pin in the fence, wherein the pin passes through the fence to an aperture below corresponding to the desired angle, and reengaging the lock knob with the angle fixture. This exemplary embodiment or another may provide the step of placing further comprises: removing at least two wheels on an exterior side of the guide; and reattaching at least two wheels on an interior side of the guide. This exemplary embodiment or another may provide the step of inserting further comprises: contacting the cutting tool with at least two points. This exemplary embodiment or another may provide contacting an edge of cutting tool against at least one abrasive surface. This exemplary embodiment or another may provide simultaneous to the contacting step: supporting the tool by at least two wheels. This exemplary embodiment or another may provide the wheels support the tool inside an interior of the tool. This exemplary embodiment or another may provide the wheels support the tool outside an exterior of the tool. This exemplary embodiment or another may provide after securing the cutting tool, resetting an angle on the angle fixture to prepare to create a micro bevel. This exemplary embodiment or another may provide contacting an edge of cutting tool against at least one abrasive surface. This exemplary embodiment or another may provide prior to setting: securing the fence to the angle fixture.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A new system 10 and method of operation thereof is depicted in the present disclosure and throughout FIGS. 1-21. System 10 is a new and improved apparatus for a cutting tool sharpening fixture, as will be discussed hereafter.

Figure 1:
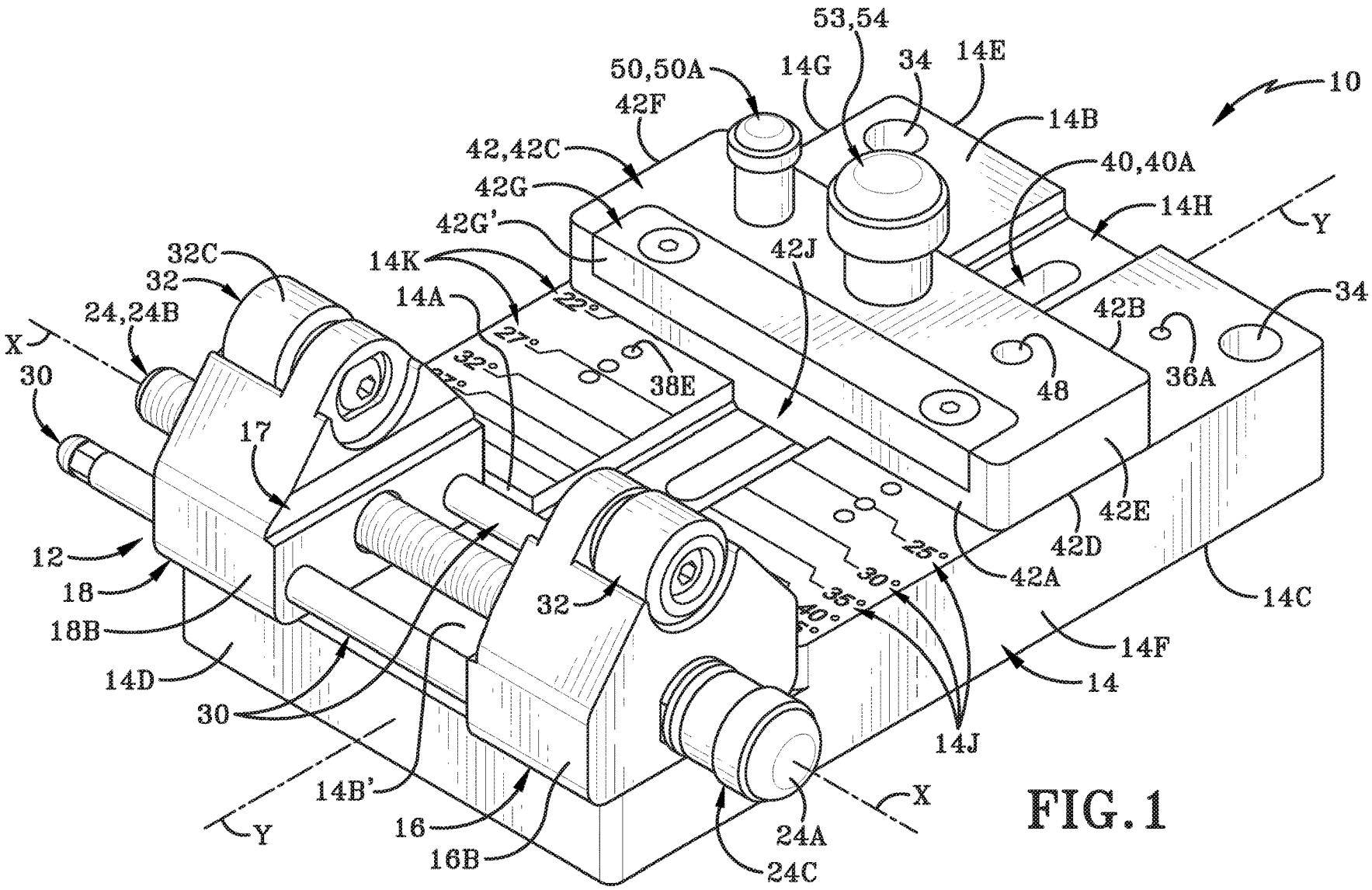
FIG. 1 is a top front right side perspective view of an exemplary cutting tool sharpening system.
Figure 2:
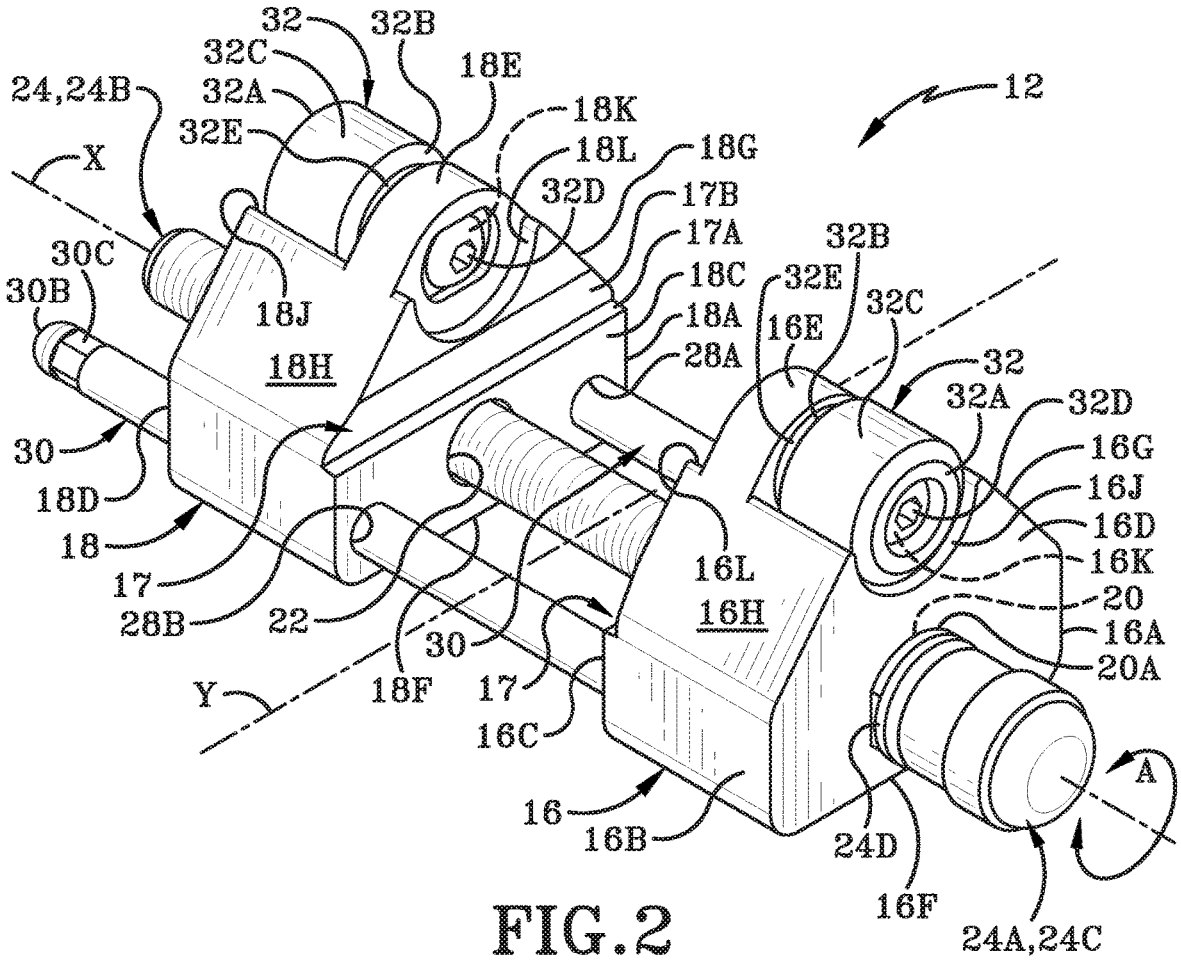
FIG. 2 is a top right side perspective view of a sharpening guide.
Figure 3:
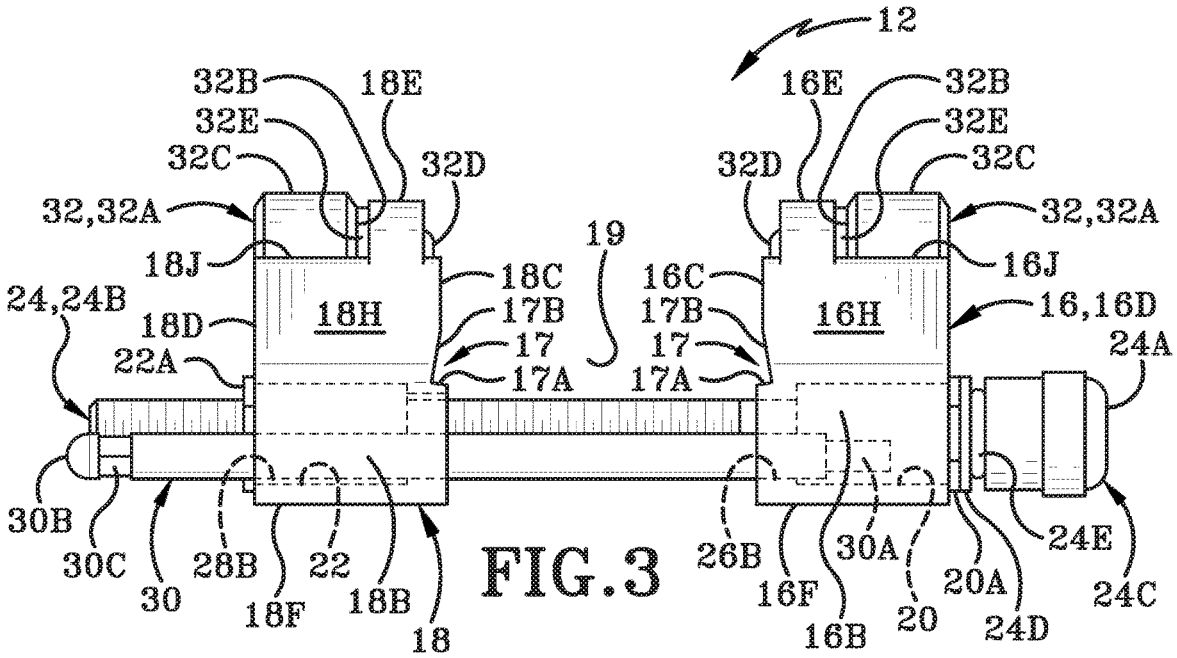
FIG. 3 is a front side perspective view of a sharpening guide.
Figure 4:
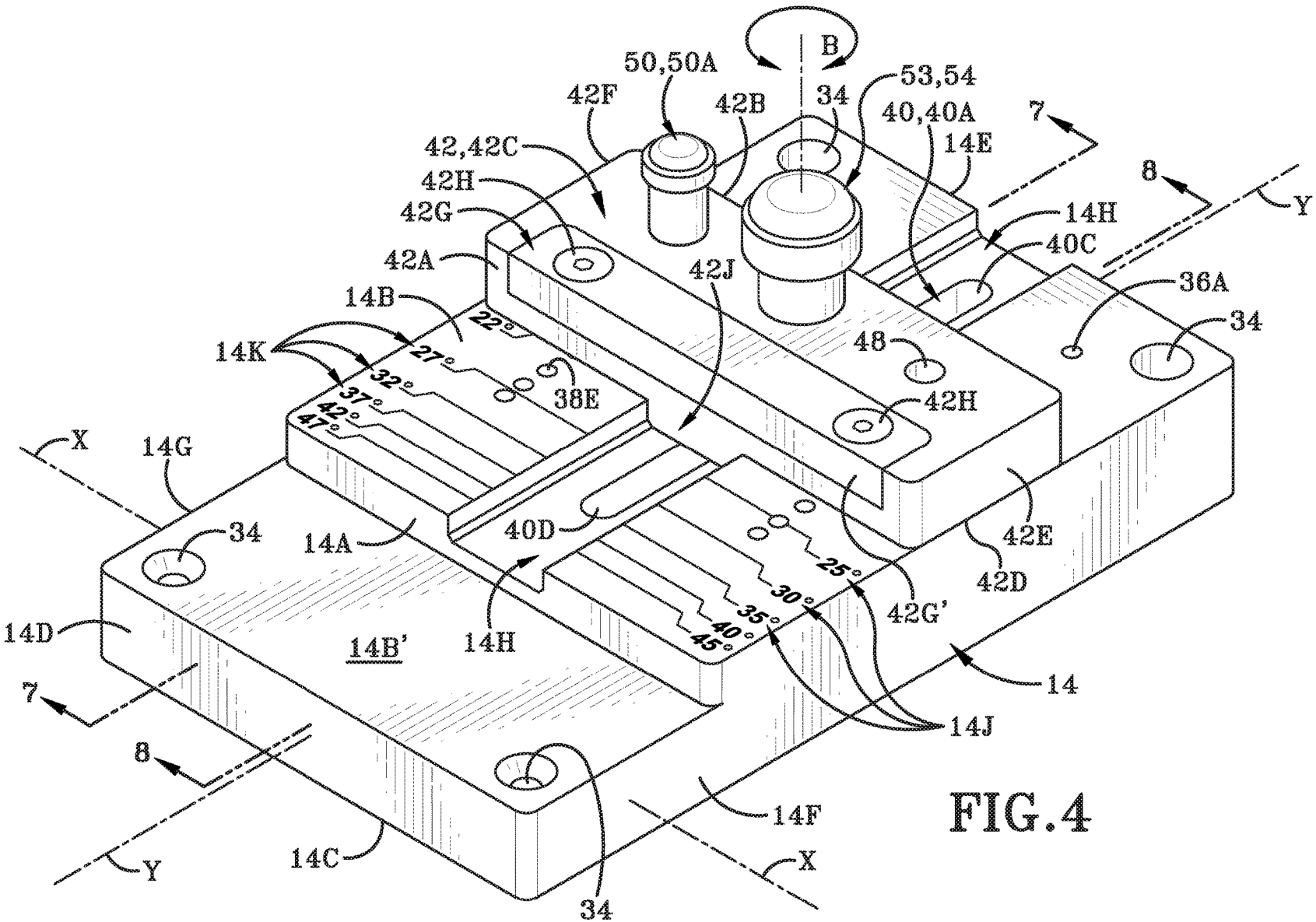
FIG. 4 is a top front right side perspective view of an angle fixture.
Figure 5:
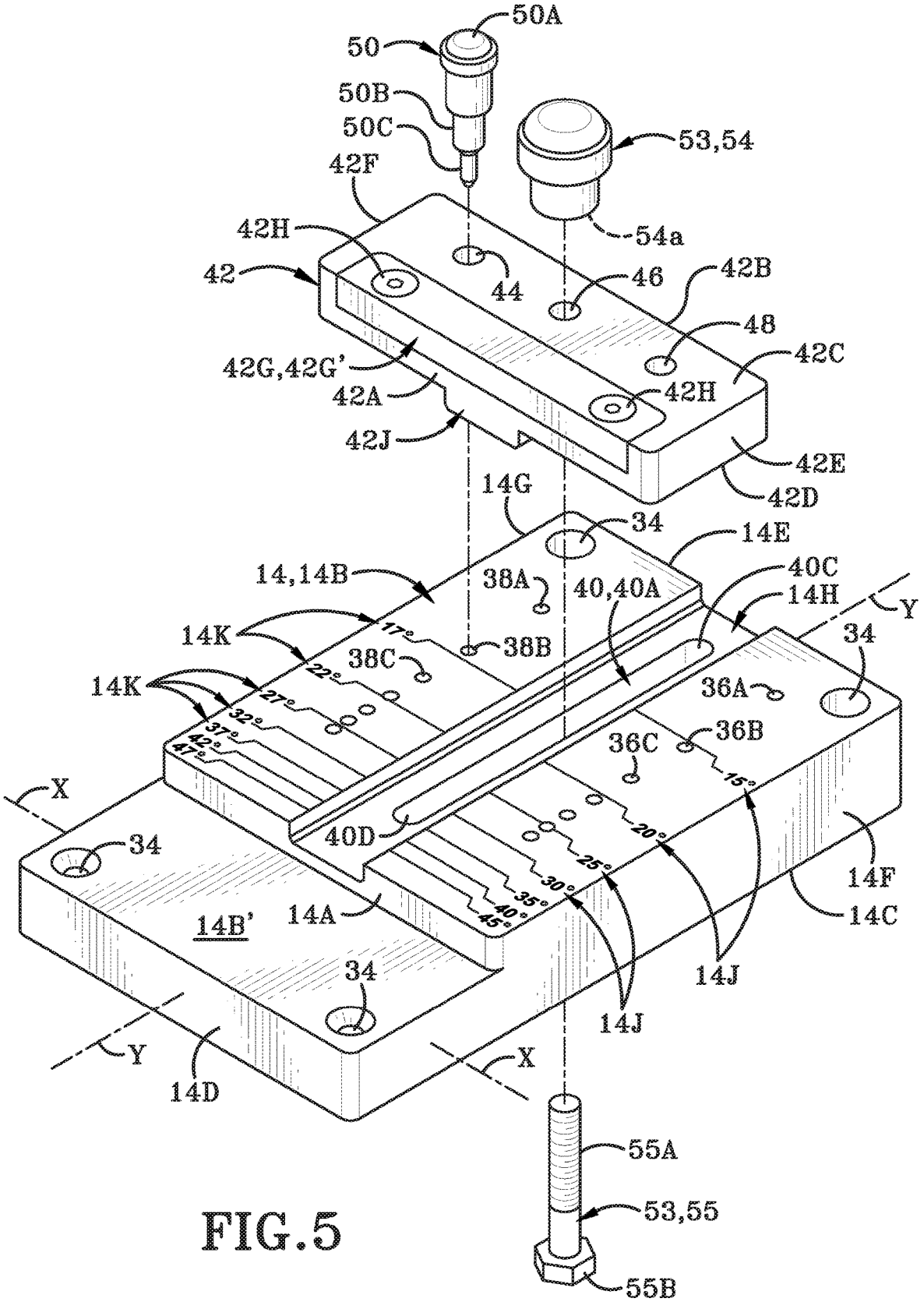
FIG. 5 is an exploded top front right perspective view of the angle fixture.
Figure 6:
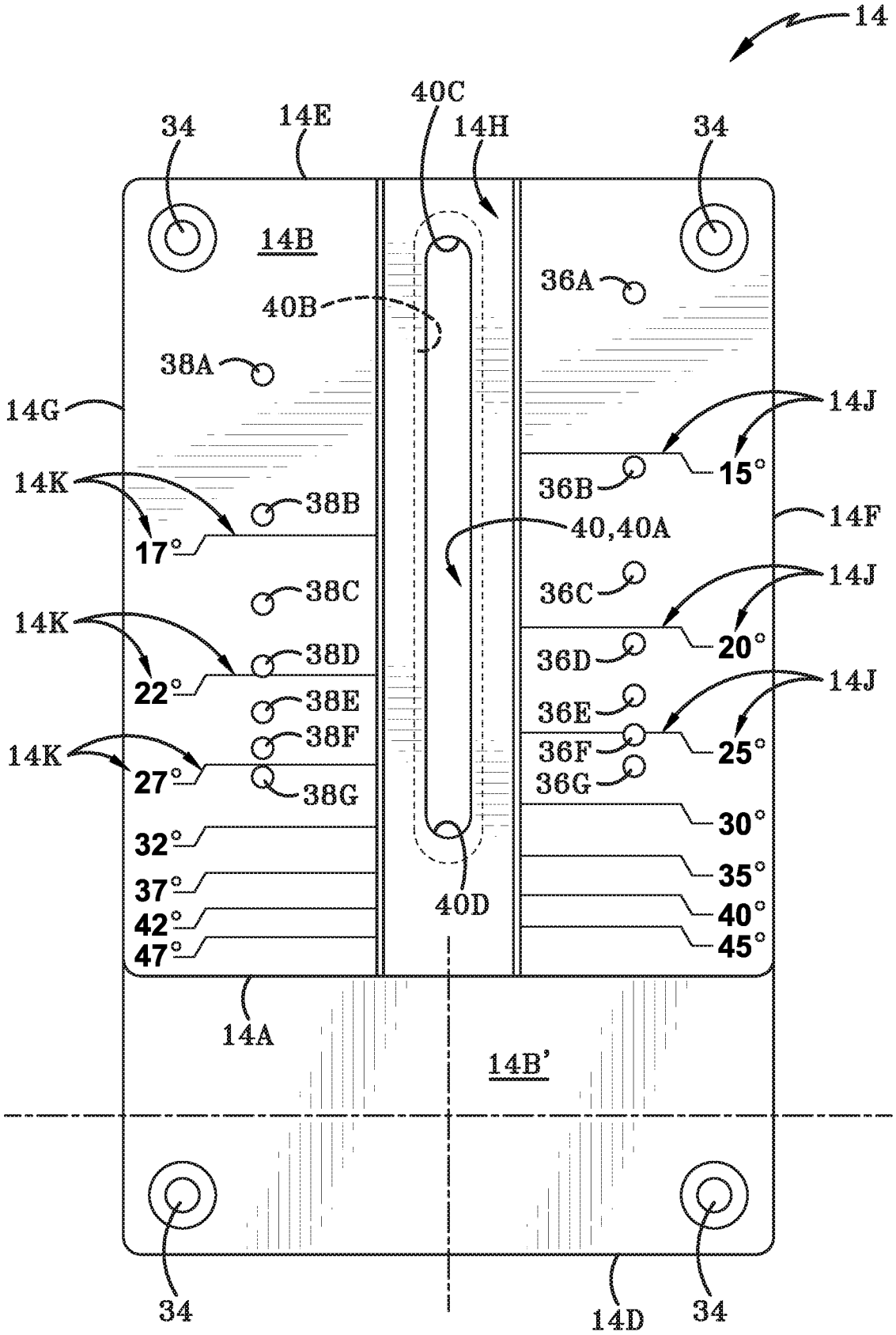
FIG. 6 is a top plan view of the angle fixture.

Referring now to FIG. 1, FIG. 2 and FIG. 3, a sharpening guide 12 and an angle fixture 14 are shown. The sharpening guide 12 has a pair of main body portions, a first main body portion 16, and a second main body portion 18 that are generally two right triangular prisms with a rounded point at their top that are generally mirror images of one another about a central Y-axis "Y". Each main body portion 16, 18 of the sharpening guide 12 has a front face 16A, 18A and a rear face 16B, 18B, with the rear face 16B, 18B being horizontally spaced from the front face 16A, 18B. Each of the front face 16A, 18A, and rear face 16B, 18B are operative to interface and abut with the angle fixture 14 at a stepped face 14A thereof. Further, each main body portion 16, 18 has their own respective interior sides 16C, 18C, exterior sides 16D, 18D that extend transversely along an X-axis "X" from a top side 16E, 18E and a bottom side 16F, 18F which extend longitudinally with respect to the Y-axis and the front face 16A, 18A and rear face 16B, 18B. Further, the first body portion 16 and second body portion 18 include front tapered portions 16G, 18G, and rear tapered portions 16H, 18H that are angled less than 90 degrees to each other. The interior sides 16C, 18C have a gripping surface which includes an angled section 17 with a ledge 17A and a top 17B meant for engaging the sides of a chisel or other tool desired to be sharpened as will be discussed later with respect to the operation within FIG. 12 and FIG. 12A. The chisel or other tool may be placed within the angled section 17 to be planar with the ledge 17A of the angled section 17. The first main body portion 16 and second main body portion 18 are spaced apart by a gap 19.

The first main body portion 16 has a through hole 20 that is lined with a smooth bore bushing 20A which is operatively attached to the through hole 20. The second main body portion 18 has a further through hole 22 lined with a threaded eyelet 22A which is operatively attached to the further through hole 22. Both of the through hole 20 and further through hole 22 are located at the same height and depth within their respective body portions 16, 18. Nestled within the through hole 20 and threaded into the threaded bushing 22A in the further through hole 22 is a screw 24. The screw has a first end 24A and a second end 24B. At the first end 24A there is a graspable portion 24C. Beyond the graspable portion a washer 24D and a deformable O-ring 24E. As the graspable portion 24C is rotated in a first direction about arrow "A" by a user, the interior side 18C of the second body portion 18 is drawn closer to the interior side 16C of the first body portion 16. Similarly, when the screw is rotated in a second direction about arrow "A", the interior sides 16C, 18C will be drawn away from one another to make the gap larger between the two portions 16, 18. This action has the effect of tightening or loosening a tool which may be mounted or desired to be removed within the gap 12A of the interior sides 16C, 18C.

The first main body 16 portion further has two blind holes 26A, 26B while the second main body portion 18 has two bores 28A, 28B. Both the blind holes 26A, 26B and the bores 28A, 28B are located at the same height and depth as one another. Further included is a pair of posts 30. The pair of posts have a first end 30A, and a second end 30B. The first ends 30A may be threaded or may be smooth or may include a variety of shapes. The second end 30B may be rounded with a hexagonal portion 30C proximate the second end 30B. The hexagonal portion 30C is so shaped to be operatively grasped by a wrench or similarly situated tool to drive The pair of posts 30 are placed individually, or one each, into each of the blind holes 26A, 26B by their first ends 30A, and operatively secured thereto. In an exemplary embodiment this operative securement may be a threaded engagement or an adhesive. The second ends 30B are aligned with the bores 28A, 28B of the second main body portion and placed therein. This allows for the main body portions 16, 18 to remain in constant alignment while the second ends 30B are placed within the bores 28A, 28B.

With continued reference to FIG. 1, FIG. 2, and FIG. 3, proximate to the tops 16E, 18E there is a pair of wheels 32. Each wheel 32 has a body that is generally cylindrical in shape and is located within a cavity 16J, 18J of the exterior sides 16D, 18D of each main body portion 16, 18. The cavities 16J, 18J are of a semi-cylindrical shape complementary to the wheels 32 that is open at the top so as to allow movement of the wheels 32. The wheels 32 include a first side 32A and a second side 32B opposed to the first side in a transverse manner. Further, the wheels have an outer engaging surface 32C. The wheels 32 are attached to the main body portions 16, 18 through the use of a pair of fasteners 32D which pass through their respective wheel apertures 16K, 18K proximate the tops 16E, 18E and secure the wheels 32 to their respective main body portions 16, 18. The wheels further include felt washers 32E adjacent to the second side 32B. As a result of the wheels 32 being in engagement, the fasteners 32D may be removed from the wheels 32 and the wheels 32 may alternatively be attached along the outside in a cavity 16L, 18L on the interior sides 16C, 18C. The cavities 16L, 18L are of a semi-cylindrical shape complementary to the wheels 32 that is open at the top so as to allow movement of the wheels 32. The impetus for moving the wheels 32 will be discussed later with respect to the operation. The wheels 32 are operative to freely rotate about the fasteners 32D. Namely, the wheels 32 are operative to rotate when their outer engaging surfaces 32C are placed on a surface and moved about that surface, as will be discussed later with respect to the operation.

Referring now to FIG. 1, FIG. 4, FIG. 5, FIG. 6, FIG. 7 and FIG. 8, the angle fixture 14 is shown. The angle fixture 14 has a body which includes the stepped ledge 14A on a top side 14B of the angle fixture 14. The stepped ledge 14A is at a lower relative height when compared to the height of the remaining part of the top side 14B. The angle fixture 14 further includes a bottom side 14C. Further with the angle fixture, a front side 14D and a rear side 14E, are present and extend longitudinally between the top side 14B and bottom side 14C. The angle fixture further comprises a first side 14F and a second side 14G extending transversely between the top side 14B and bottom side 14C.

The top side 14B has a plurality of through holes 34. The plurality of through holes 34 extend from the top side 14B to the bottom side 14C. The through holes are operative to secure the angle fixture 14 to a work surface when screws or other similarly situated fasteners are placed within the through holes 34 and contact both the through holes 34 and the work surface. Further, there are a plurality of angle apertures 36; specifically, 36A, 36B, 36C, 36D, 36E, 36F, 36G. Additionally the top side 14B includes a plurality of micro bevel apertures 38; specifically, 38A, 38B, 38C, 38D, 38E, 38F, 38G located on the top side 14B that pass through to the bottom side 14C. The Further, the top side 14B includes a plurality of indicia for angles 14J of a chisel or other tool on a right side. In the exemplary embodiment, the listed indicia for angles 14J are all five degree increments from 15 degrees to 45 degrees. Additionally, in the exemplary embodiment, the top side also includes a plurality of micro bevel indicia angles 14K for a micro bevel for a chisel or other tool on a left side in five degree increments from 17 degrees to 47 degrees. These values listed in the indicia are merely examples and other values could be used.

The top side 14B further includes a recessed track channel 14H with a central path 40 located within the track channel 14H. The recessed track channel 14H runs from the stepped ledge 14A to the rear side 14E of the angle fixture 14. The central path 40 contains an upper narrow portion 40A and a lower wider portion 40B and has two parallel sides along with a rounded edge at its first end 40C and second end 40D.

Resting on top of the top side 14B of the angle fixture is a fence 42. The fence 42 has a body that includes a front surface 42A and a rear surface 42B. The fence 42 further includes a top side 42C and a bottom side 42D extending transversely with respect to the front surface 42A and rear surface 42B. A first side 42E and a second side 42F extend longitudinally between a front surface 42A and a rear surface 42B. Spanning a portion of the front surface 42A and the top surface 42C is a stop 42G. The stop 42G is made of a different material of the fence 42 and is removable therefrom as it is attached to the fence 42 via fasteners 42H. The stop 42G further includes a tool engaging surface 42G'. At the bottom side 42F, there is a projection portion 42J. The projection portion 42J is complementary in shape to the recessed track channel 14H and is operative to move along the recessed track channel 14H as a result.

Figure 7:
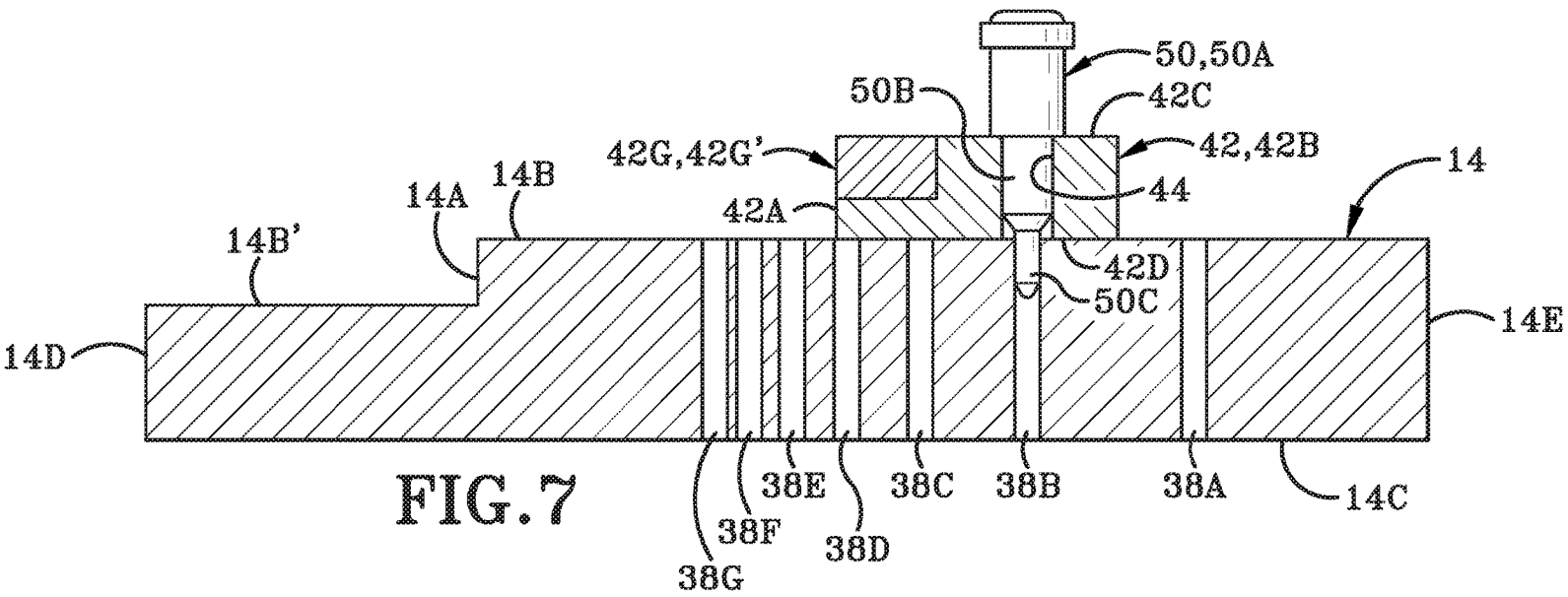
FIG. 7 is a right cross-sectional view of the angle fixture taken along line 7-7 of FIG. 4.

Extending through the top surface 42C of the fence 42 there are three apertures, moving from left to right, a micro bevel aperture 44, an index aperture 46 and an angle aperture 48. Both the micro bevel aperture 44 and the angle aperture 48 are operative to be engaged by an index pin 50. The index pin 50 has a first end 50A of greater diameter to be received by the micro bevel aperture 44 or angle aperture 48 and which is operative to be grasped by a user, an intermediate portion 50B and a second end 50C which is operative to fit in either the micro bevel aperture 44 or angle aperture 48 and then passing through to be engaged with a micro bevel aperture 38 or angle aperture 36, respectively. This engagement is shown in FIG. 7 as the index pin 50 engages with the bevel aperture 38B.

Figure 8:
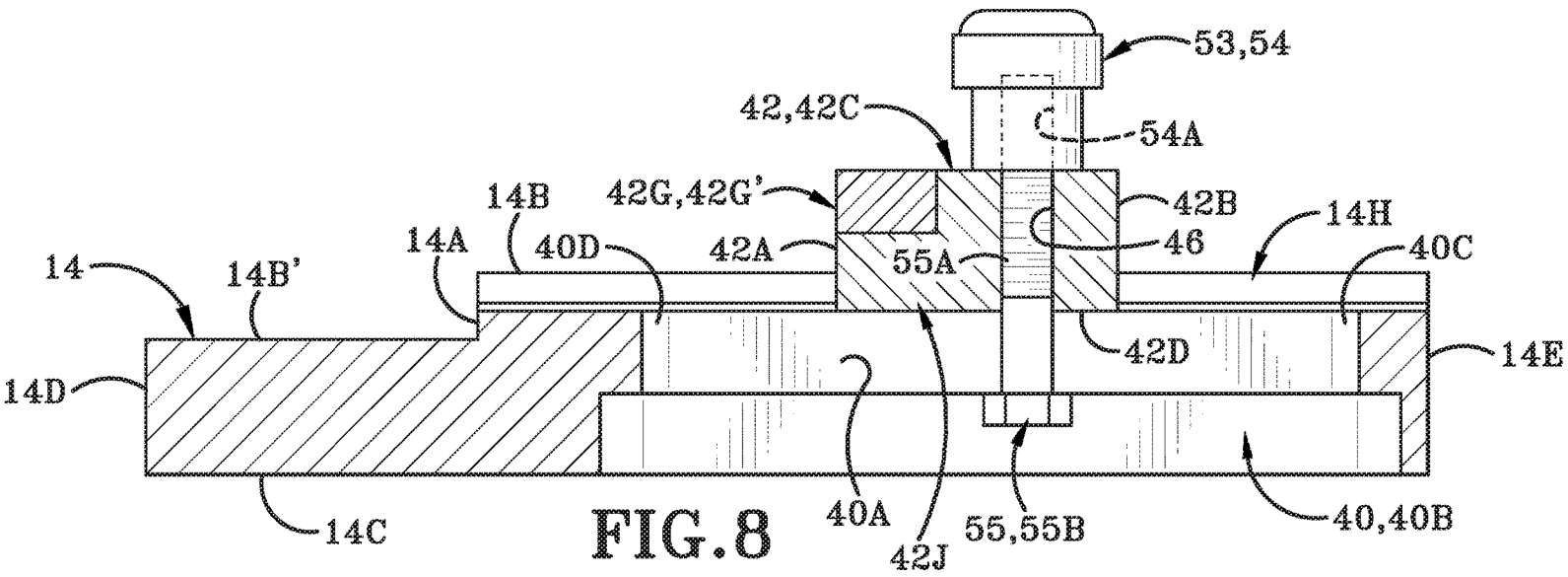
FIG. 8 is a cross-sectional right side view of the angle fixture taken along line 8-8 of FIG. 4.

Further, the index aperture 46 is engaged by a locking mechanism 53. The locking mechanism includes a lock knob 54 with a threaded bore 54A. The threaded bore is operative to be engaged by the threaded portion 55A of a bolt 55. The bolt 55 further includes a head 55B operative to be wider than the central path 40, specifically the upper narrow portion 40A while the threaded portion 55A of the bolt 55 is slightly less than the width of the central path 40 at its narrow portion 40A. This engagement is shown in FIG. 8 with the threaded portion 55A engaged with the knob portion 54 within the central path 40. Operation of the lock knob 54 and index pin 50 will be discussed later with respect to the operation of the entire system 10.

Figure 9:
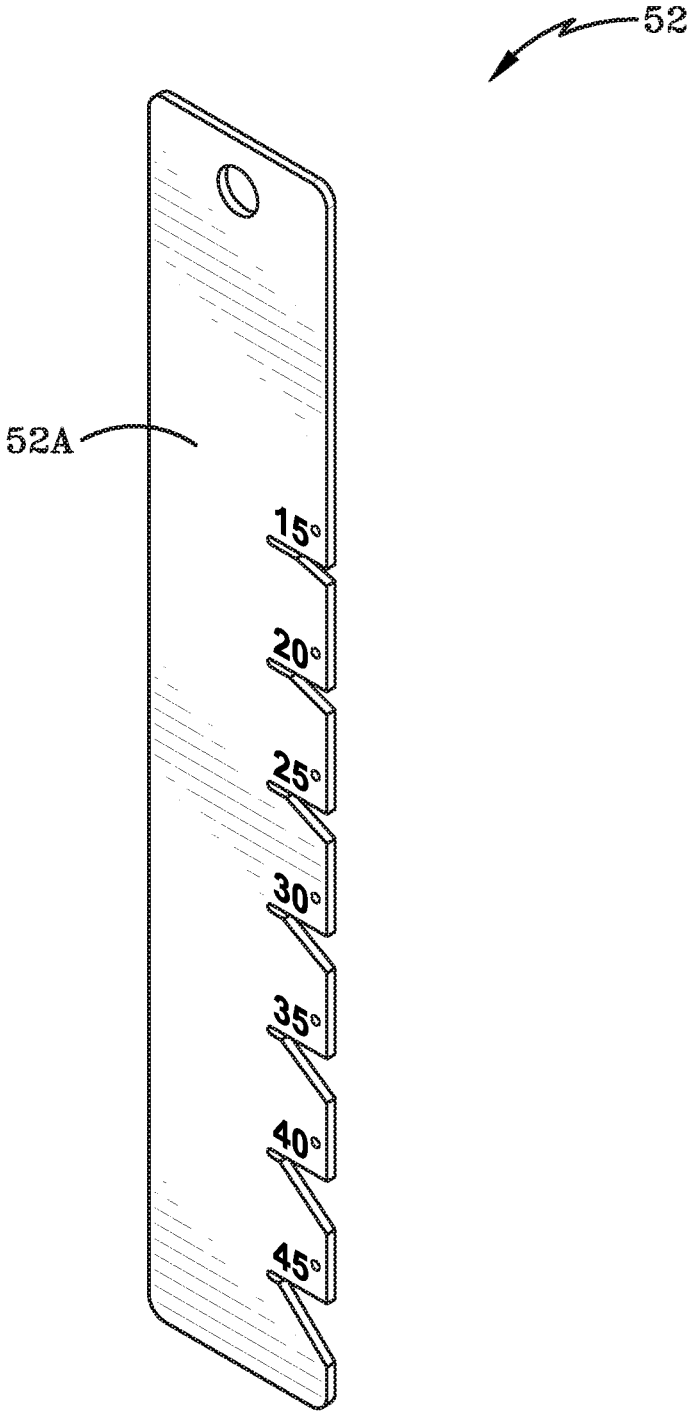
FIG. 9 is a right side perspective view of an angle gauge.

Referring now to FIG. 9, an angle gauge 52 is shown. The angle gauge includes a first side 52A with various angles embossed therein. The various angles included in the angle gauge are used to check the angle of a tool either prior to operating the system 10 including the sharpening guide 12, the angle fixture 14 and the angle gauge 52, or after operating the system 10 to check the angles of an exemplary tool.

Figure 10:
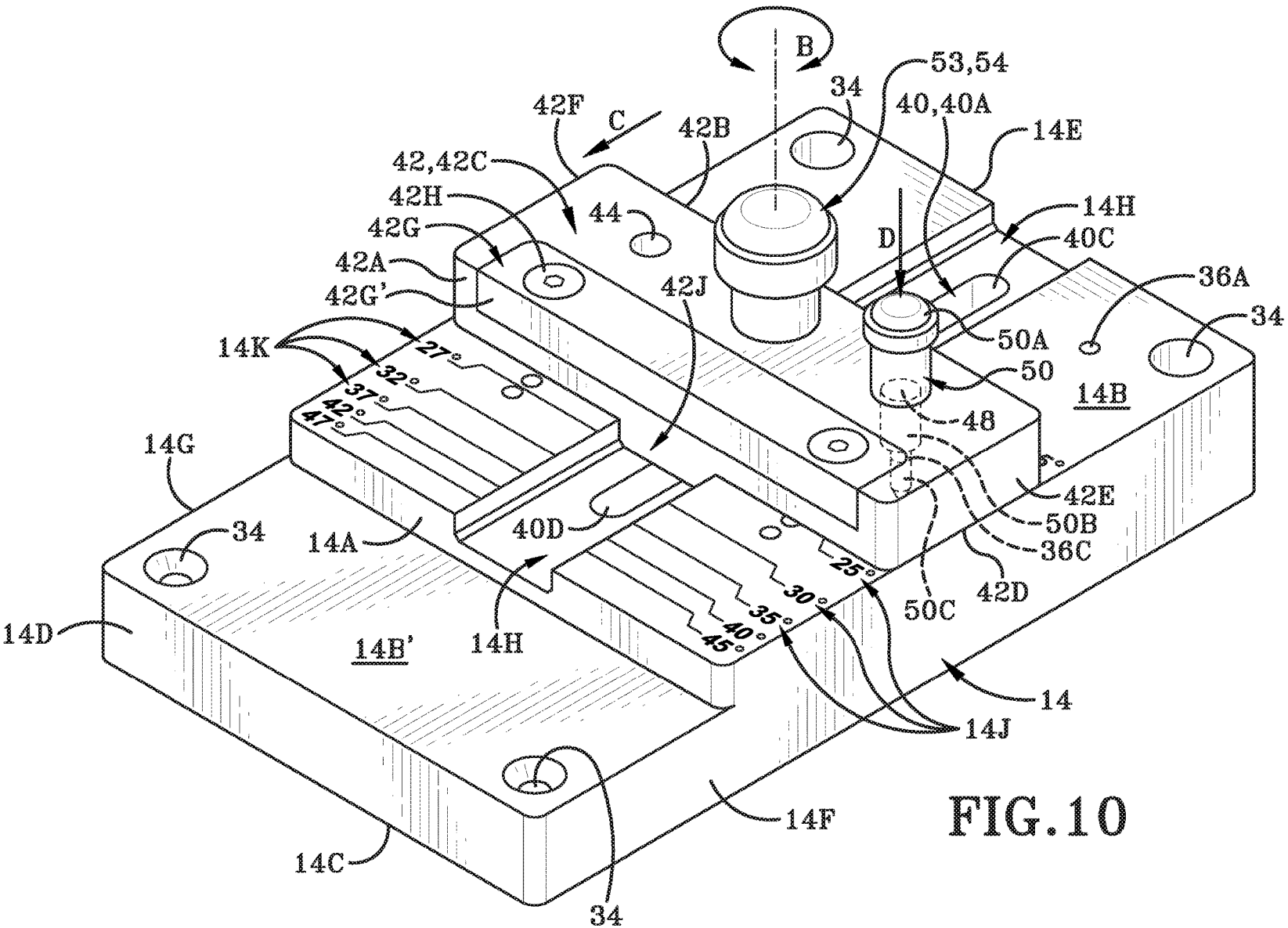
FIG. 10 is top right side perspective view of the angle fixture in operational view setting an angle.

Having thus described an exemplary non-limiting configuration of the system 10, its operation will be discussed with reference to some exemplary features used with the various embodiments. Referring specifically to FIG. 10, a user identifies a tool needed to be sharpened to have a more defined edge. The user may then pick an angle to sharpen the tool. After the user picks the angle to sharpen the tool, they align the fence 42 at its front 42A with the angle of their choosing using the angle indicia 14J as a guide. If the fence 42 is not already at the desired angle, the lock knob 54 of the locking mechanism 53 may be rotated in a first direction. By rotating the lock knob 54 in a first direction the knob 54 becomes partially disengaged from the threaded portion 55A of the bolt 55 and the head 55B is no longer in direct contact with the bottom of the central path 40 of the track channel 14H. The user further removes the index pin 50 from the angle aperture 48 of the fence 42.

As a result of the knob portion 54 of the locking mechanism 53 being turned and the index pin 50 being free, the fence 42 may be moved freely in a transverse manner within the track channel 14H. In the present example, the angle chosen by a user is 25 degrees. Therefore, the fence 42 is moved to align the front end 42A with the 25-degree marker indicated by arrow "C". The index pin 50 is placed into the index aperture 46 where it passes through the body of the fence 42 to make contact with the angle aperture 36C below indicated by arrow "D". The knob portion 54 is then rotated in a second direction causing the engagable portion to thread into the knob portion 54. This causes the head 50C to abut directly with the bottom portion of the central path 40 and hold the head in engagement with the central path.

The top 14B of the angle fixture 14 includes markings for seven different angles 14J, of which there are a corresponding seven angle apertures 36. Each angle aperture 36 refers to a different angle. Angle aperture 36A corresponds to a 15 degree angle. Angle aperture 36B corresponds to a 20 degree angle. Angle aperture 36C corresponds to a 25 degree angle. Angle aperture 36D corresponds to a 30 degree angle. Angle aperture 36E corresponds to a 35 degree angle. Angle aperture 36F corresponds to a 40 degree angle. Angle aperture 36G corresponds to a 45 degree angle.

Figure 11:
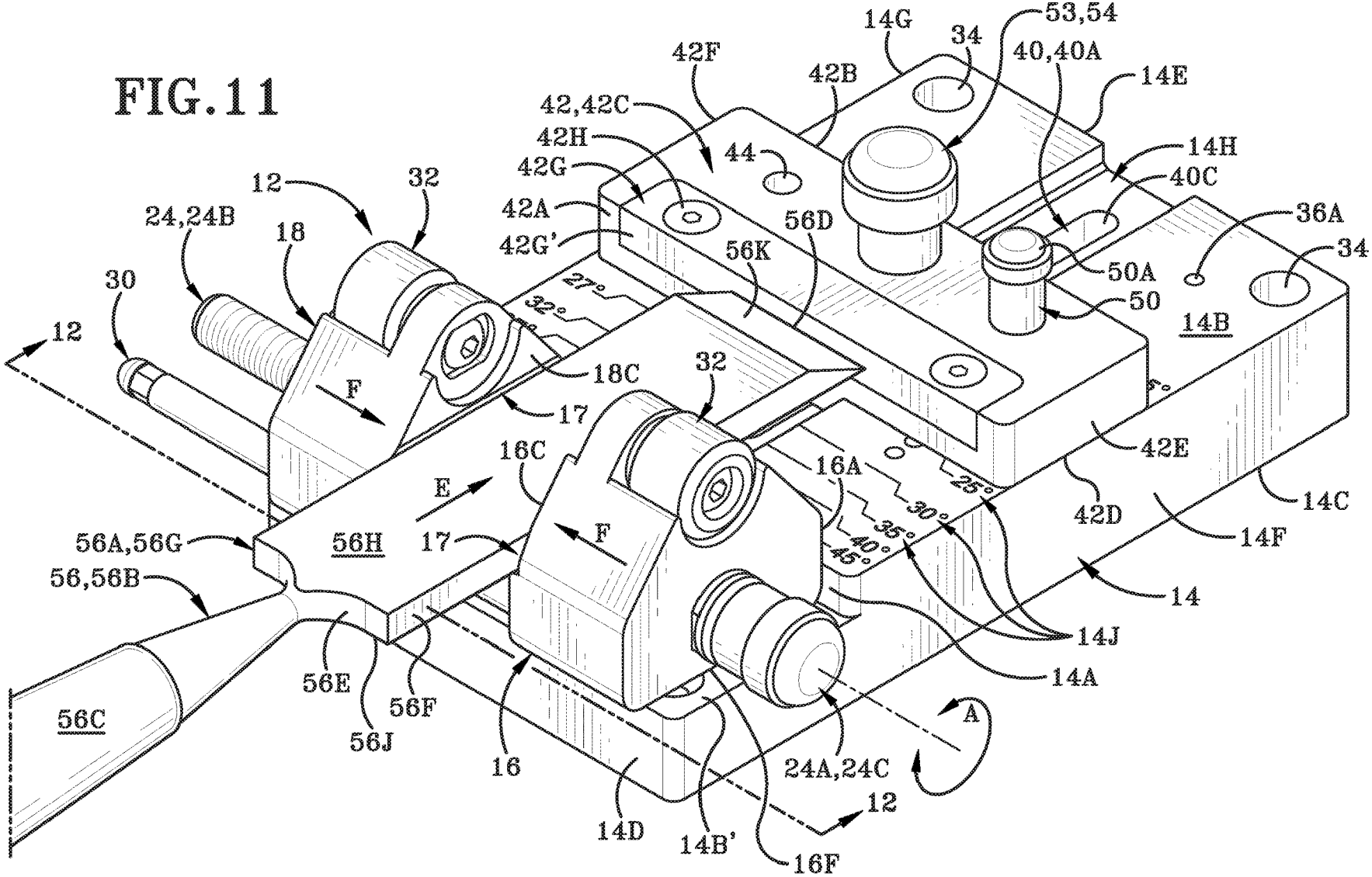
FIG. 11 is a top right perspective view of an angle gauge abutted to the sharpening guide in operation with a tool.

Continuing on to FIG. 11, a tool 56 is placed within the sharpening guide 12. The tool 56 has a body which includes a blade portion 56A, a neck 56B, a handle portion 56C, a tip or first end 56D, a second end 56E longitudinally opposed from the first end 56D, a first side 56F, a second side 56G transversely opposed from the first side 56F, a top 56A and a bottom 56J, an angled or beveled portion 56K adjacent to the first end 56D. The bottom 16F of the first body portion 16 and the bottom 18F of the second body portion 18 are placed onto the stepped face 14A of the angle fixture 14. The tool 56 makes contact with the angled section 17 an interfaces with the ledge 17A. The graspable portion 24C of the screw 24 is then rotated in a first direction if the first body portion 16 and second body portion 18 are desired to be opened wider, or may be rotated in a second direction if the first body portion 16 and second body portion 18 are desired to be closed. The tool 56 is placed between the gripping surfaces 16C', 18C' of each respective body portion 16, 18, and the tip 56D with the of the tool 56 is placed into contact with the stop 42G of the fence 42 as indicated by arrow "E". Then, the graspable portion 24C of the screw 24 is rotated in the second direction in order to bring the gripping surfaces 16C', 18C' into securable contact with the non-cutting sides including the first side 56F and second side 56G of the tool 56 as indicated by the two arrows labeled "F".

Figure 12:
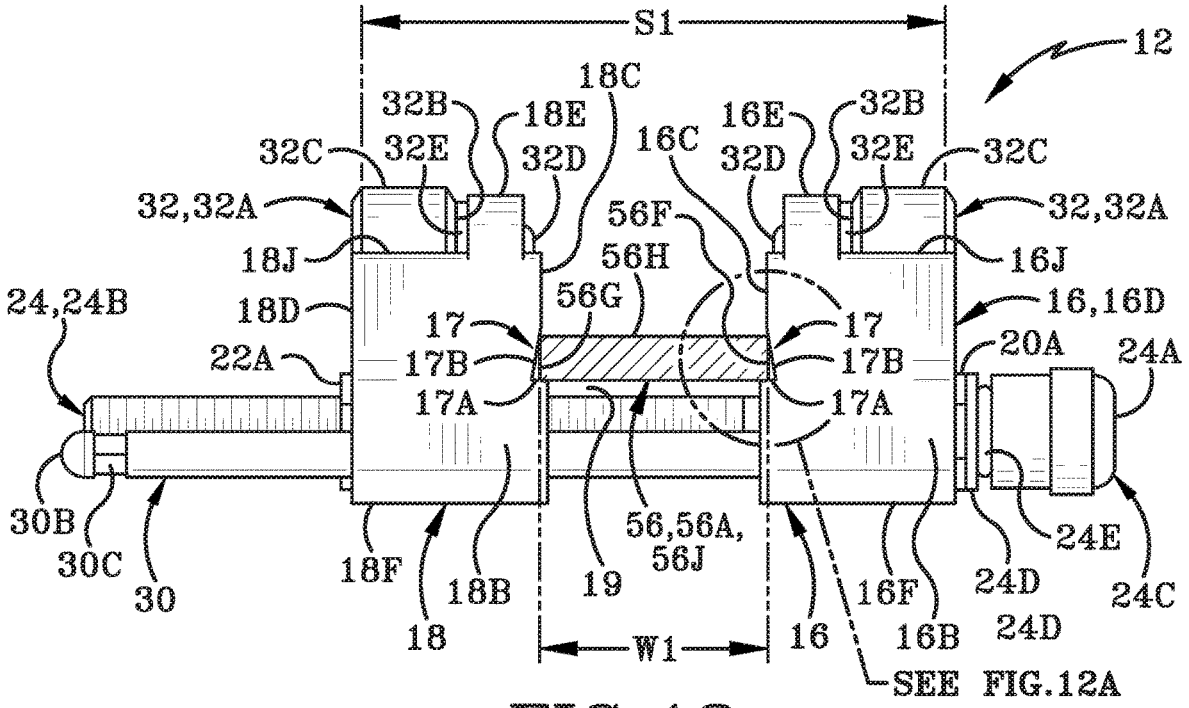
FIG. 12 is a front sectional view of the configuration of the sharpening guide engaged with the tool.
Figure 12A:
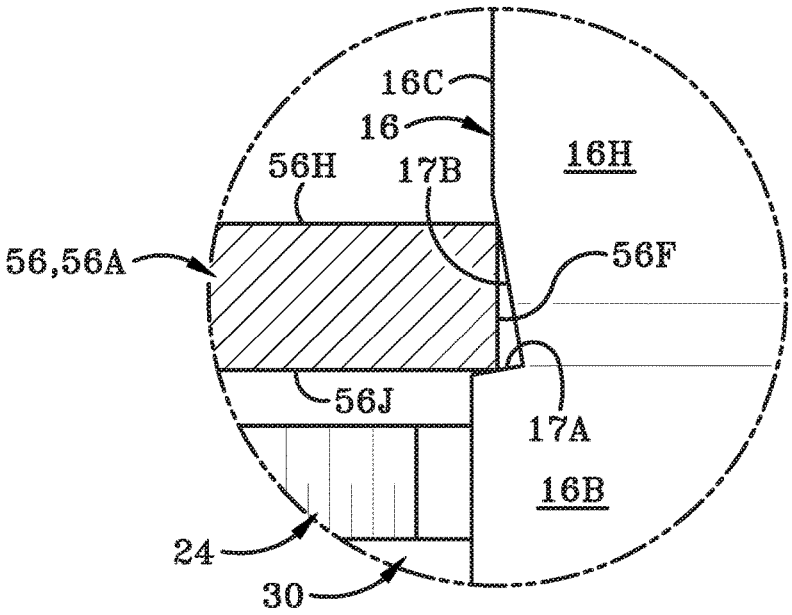
FIG. 12A is an enlarged portion of a front sectional view of the configuration of the sharpening guide engaged with the tool.

Continuing on to FIG. 12 and FIG. 12A, a front sectional view of the configuration of the sharpening guide 12 engaged with the tool 56 is shown. The gripping surfaces 16C', 18C' of each respective body portion 16, 18 are engagably abutted with the non-cutting sides 56F, 56G of the tool 56. The width of the tool "W1" as well as the width of the wheels 32 "S1" are shown in this view. Further, as is seen in FIG. 12A, the gripping surfaces are so shaped so as to accept angled edges of the non-cutting sides of a further tool, while still maintaining contact with tools with square edges.

Figure 13:
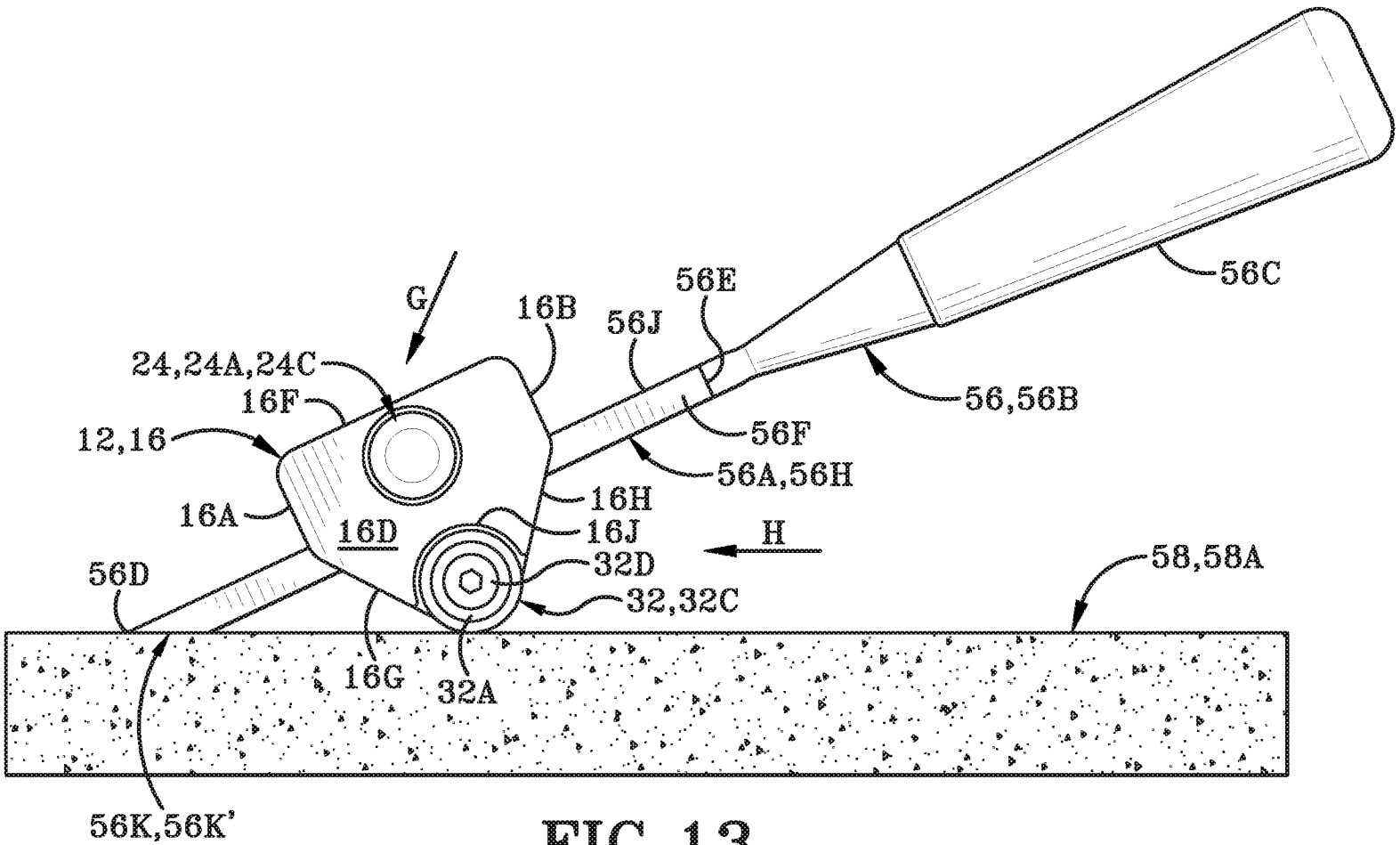
FIG. 13 is a right side perspective view of a tool being moved across a whetstone while engaged with the sharpening guide.

Referring now to FIG. 13, a side perspective view of the tool 56 being moved across a whetstone 58 while engaged with the sharpening guide 12. The handle 56C of the tool 56 is used to lift the tool 56 now fixedly attached to the sharpening guide 12. The sharpening guide 12 is now inverted so that two points make contact with a sharpening surface 58A of the whetstone 58. In the exemplary embodiment these two points may be the wheels 32, but in other embodiments a low friction interface, sled or other configuration are contemplated. Force is then applied by a user to bring the edge 56D into contact with the sharpening surface 58A. This force is indicated by arrow "G". This force "G" is continuously applied while the edge 56D of the tool 56 is in contact with the sharpening surface 58A of the whetstone 58. The edge 56A of the tool 56 is then dragged across the sharpening surface 58A as shown by arrow "H", and is supported at two points by the wheels 32. As a result of the two-point support, the sharpening guide 12 is considerably more stable when compared to prior art versions that exist currently. Therefore, risk of injury is greatly reduced when working with the sharpening guide discussed herein.

Figure 14:
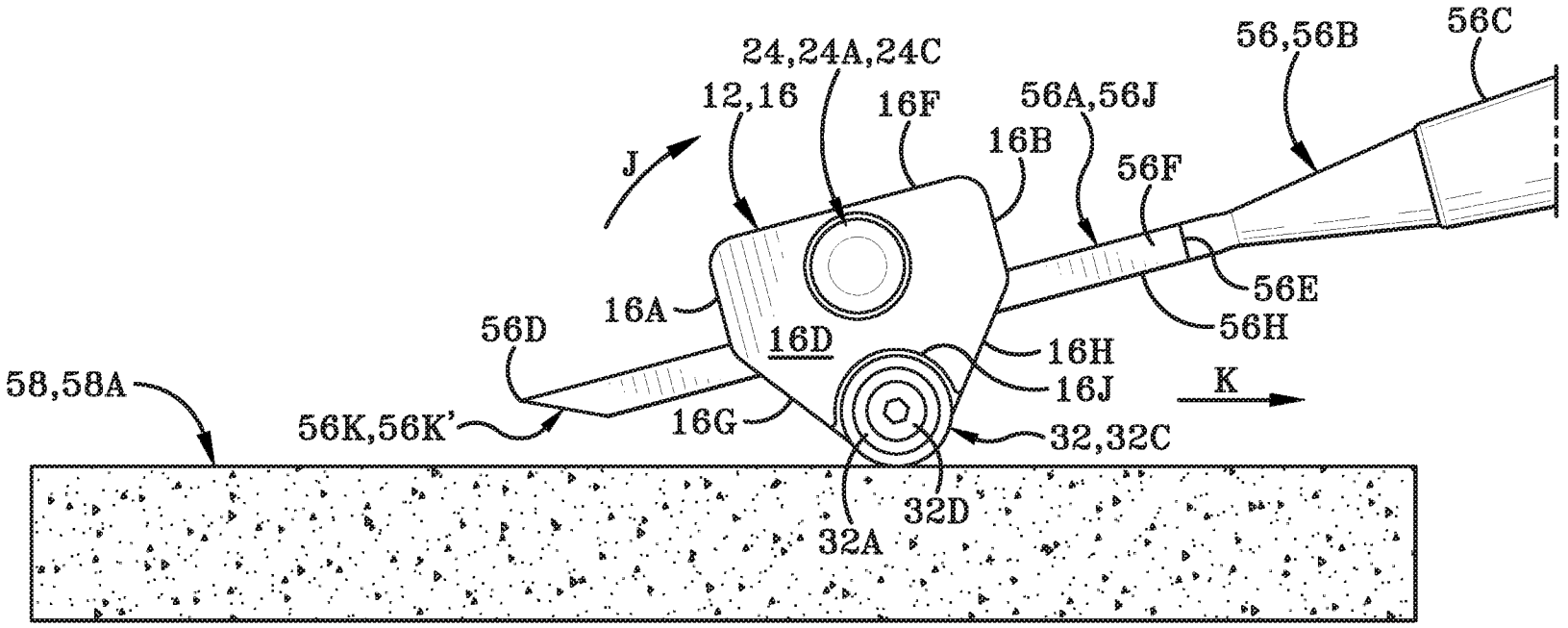
FIG. 14 is a right side view of a tool having been moved across a whetstone.

Continuing on to FIG. 14, a right side view of the tool 56 having been moved across a whetstone 58. The tool 56 is then tilted "J" by its handle 56C about the wheel 32 and is then rolled back, still being supported at two points by the wheels 32 at their outer engaging surface 32C, across the sharpening surface 58A of the whetstone 58 indicated by arrow "K". As such, pressure is only applied in one direction to forming a sharp edge. As a result, the movement as shown in FIG. 13 and FIG. 14 may be repeated until the edge 56D of the tool 56 is adequately sharpened. This may then present a main angle 56K' of the angled first end 56K.

Figure 15:
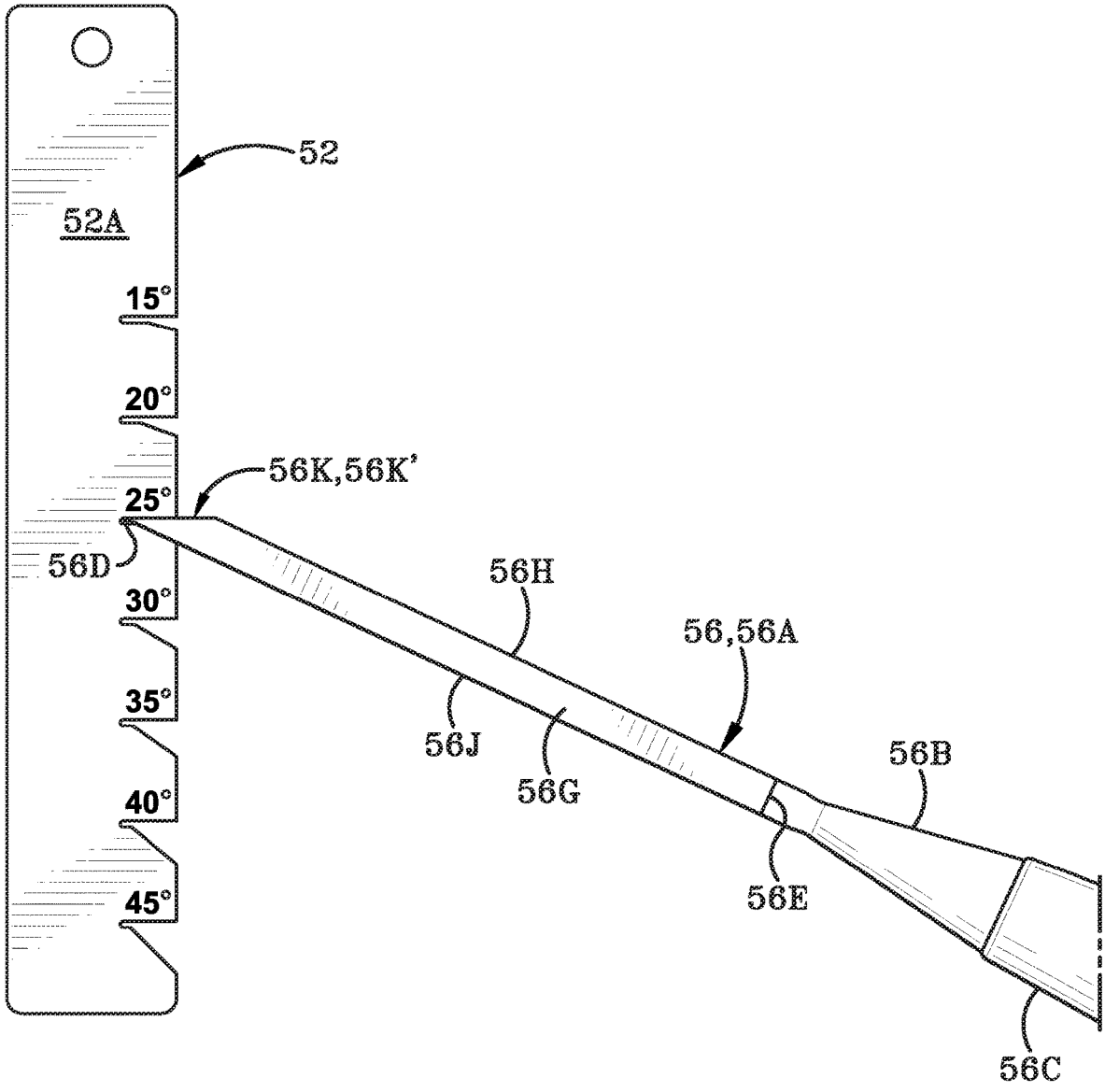
FIG. 15 is a view of an angle gauge being used to check the sharpness of a tool.

Referring now to FIG. 15, the angle gauge 52 being used to check the sharpness of the angled portion 56K, or refined portion 56K' of the tool 56. At any time, it may be necessary to determine the angle of the edge of any tool. Therefore, one may abut the edge of a tool with an aperture on the angle gauge 52. This will insure the correct angle was chosen initially, as well as determining if the angle is back to sharp.

Figure 16:
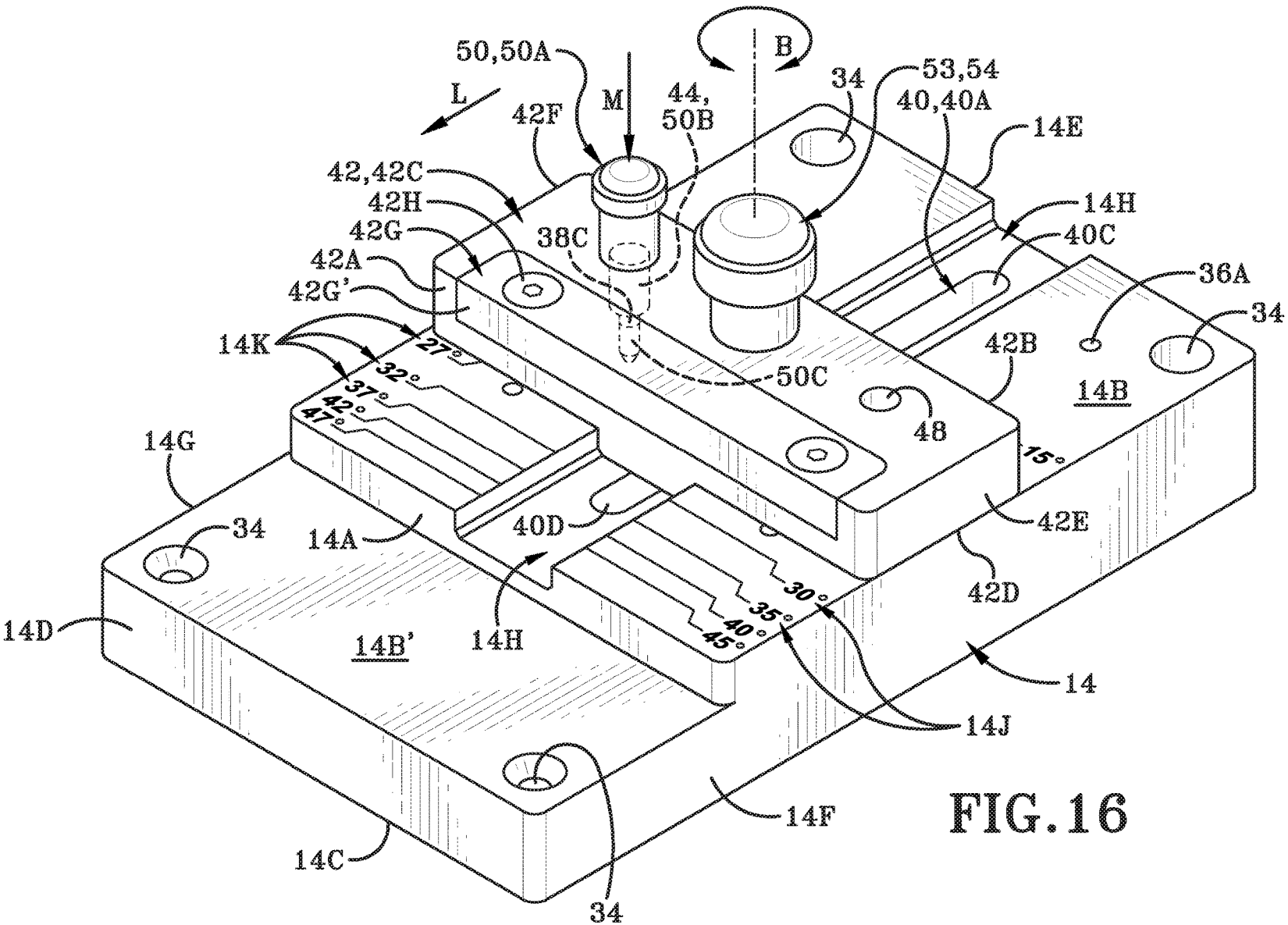
FIG. 16 is a top right side perspective view of the angle fixture being adjusted to a micro bevel level.
Figure 17:
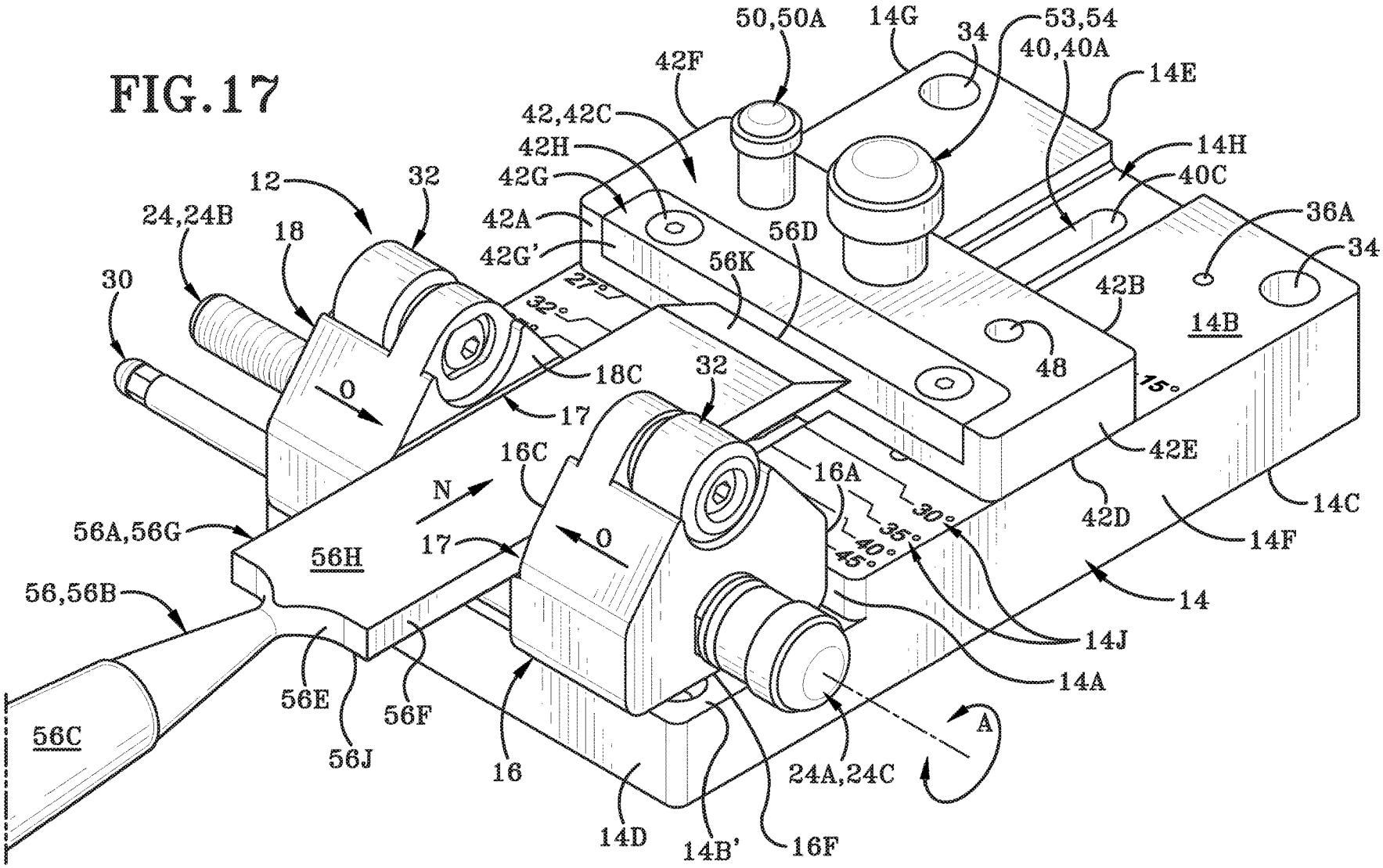
FIG. 17 is a tool being abutted with the sharpening guide and angle fixture to allow to form a micro bevel.

Continuing on to FIG. 16 and FIG. 17, a top right side perspective view of the angle fixture 14 being adjusted to a micro bevel level for finishing the edge 56A of a tool 56. After making the first refined edge 56K' of the tool 56 sufficiently sharp, it may be desired to further process the edge to form a micro bevel. Therefore, the user picks the angle to micro bevel the tool 56, they align the fence 42 at its front 42A with the angle 2 degrees greater than that of the previous level. The lock knob 54 may then be rotated in a first direction. By rotating the lock knob 54 in a first direction the knob 54 becomes partially disengaged from the threaded portion 55A of the bolt 55 and the head 55B is no longer in direct contact with the bottom of the central path 40 of the track channel 14H. The user further removes the index pin 50 from the angle aperture 48 of the fence 42.

As a result of the knob portion 54 being turned and the index pin 50 being free, the fence 42 may be moved freely in a transverse manner within the track channel 14H. In the present example, the angle chosen by a user was 25 degrees, therefore the micro bevel angle will be 27 degrees. Therefore, the fence 42 is moved to align the front end 42A with the 27-degree marker as indicated by arrow "L". The index pin 50 is placed into the micro bevel aperture 44 where it passes through the body of the fence 42 to make contact with the micro bevel aperture 38C below as indicated by arrow "M". The knob portion 54 is then rotated in a second direction causing the engagable portion to thread into the knob portion 54. This causes the head 50C to abut directly with the bottom portion of the central path 40 and hold the head in engagement with the central path. The tool 56 is still within the sharpening guide 12. Similar to earlier with respect to FIG. 10 and FIG. 11, the edge 56D of the tool 56 is placed into contact with the stop 42G of the fence 42 as indicated by arrow "N". The graspable portion 24C of the screw may 24 be rotated in order to determine that the tool 56 is still engagably secured with the first body portion 16 and second body portion 18 as indicated by arrows "O". The deformable o-ring 24E may flex if the tool 56 is very tightly engaged with the sharpening guide 12, thereby preventing damage to the tool 56 itself while being an indicator of force applied by the user.

The top 14B of the angle fixture 14 includes markings for seven different angles, of which there are a corresponding seven bevel apertures 38. Each bevel aperture 38 refers to a different angle. Bevel aperture 38A corresponds to a 17 degree angle. Bevel aperture 38B corresponds to a 22 degree angle. Bevel aperture 38C corresponds to a 27 degree angle. Bevel aperture 38D corresponds to a 32 degree angle. Bevel aperture 38E corresponds to a 37 degree angle. Bevel aperture 38F corresponds to a 42 degree angle. Bevel aperture 38G corresponds to a 47 degree angle.

Figure 18:
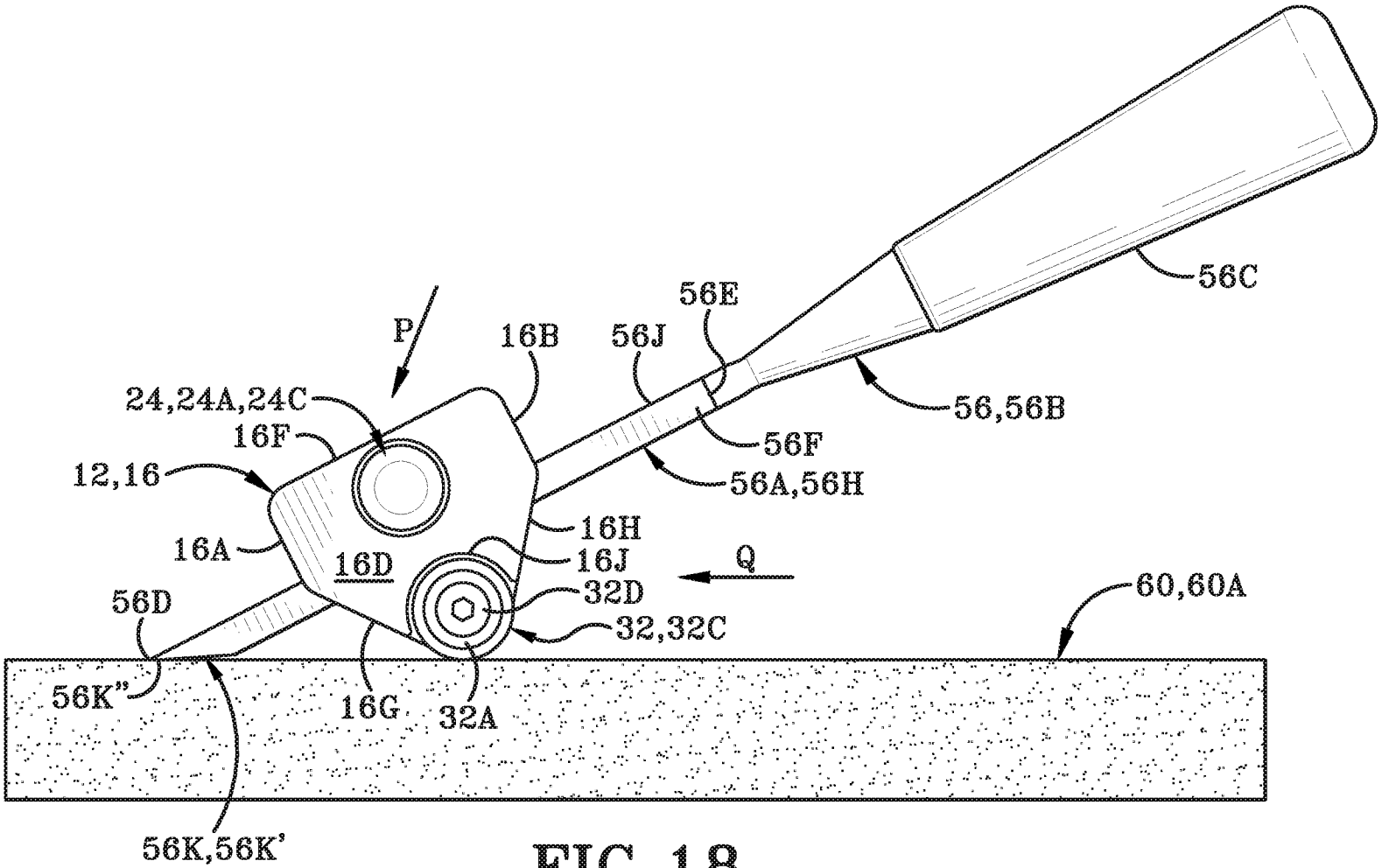
FIG. 18 is a right side view of the tool moving across a further whetstone while engaged with the sharpening guide.

Referring now to FIG. 18, a view of the tool 56 moving across a further whetstone 60. The further whetstone 60 may be of a finer grit on its sharpening surface 60A so as to better sharpen the edge 56D of the tool 56. Similar to above with respect to FIG. 13, the handle 56C of the tool 56 is used to lift the tool 56 still fixedly attached to the sharpening guide 12. The sharpening guide 12 is now inverted so that the wheels 32 make contact at the outer engaging surface 32C with a sharpening surface 58A of the whetstone 58. Force is then applied by a user to bring the edge 56A into contact with the sharpening surface 58A. This force is indicated by arrow "P". This force "P" is continuously applied while the edge 56D of the tool 56 is in contact with the sharpening surface 58A of the whetstone 58. The edge 56D of the tool 56 is then dragged across the sharpening surface 58A, and is supported at two points by the wheels 32 indicated by arrow "Q". This force "P" differs slightly from the force "G" as the angle has changed and therefore in order to make the greater angle, force must be differentially applied. This force results in the micro-bevel edge 56K".

Figure 19:
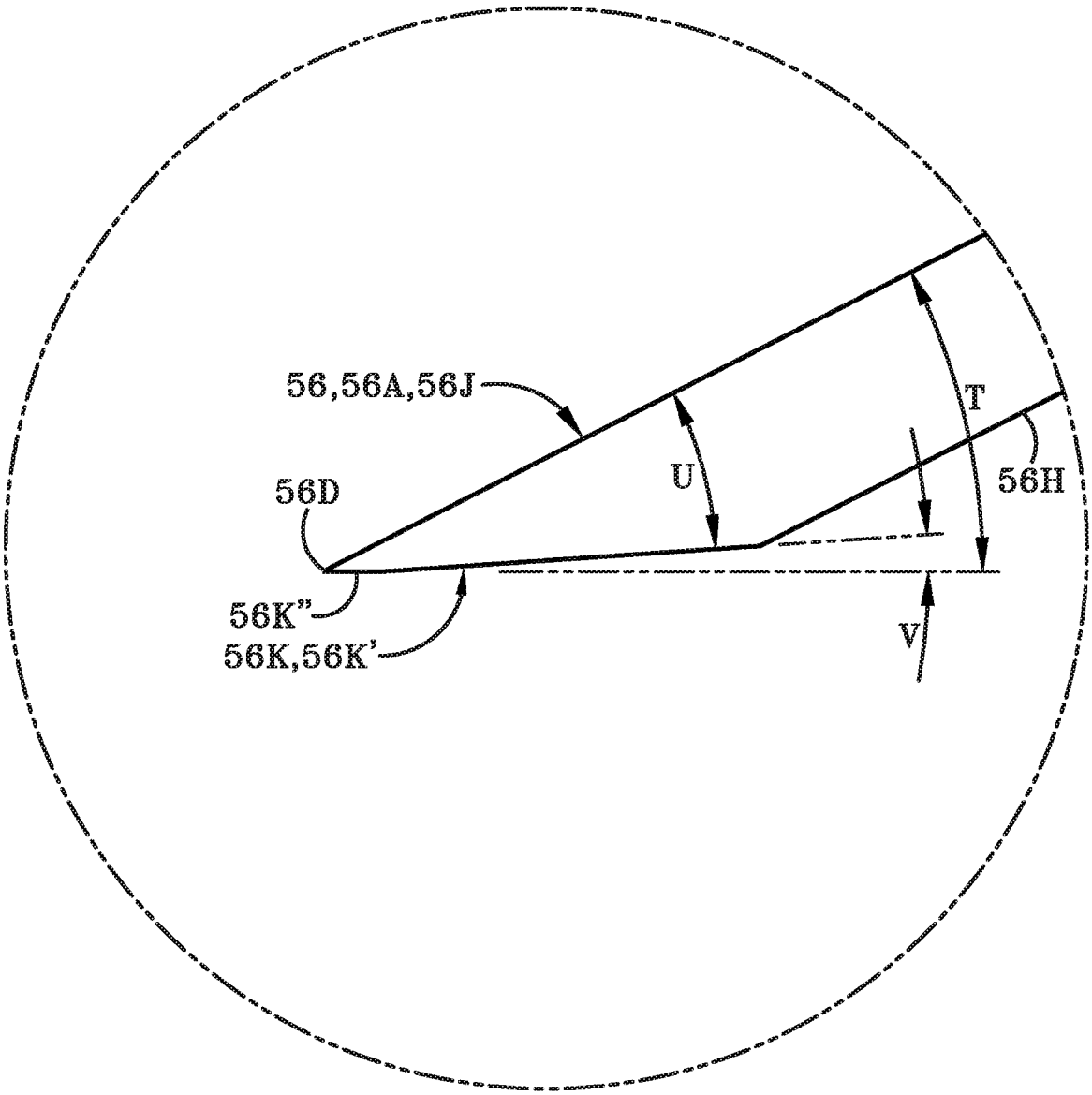
FIG. 19 is a view showing an angle difference of the micro bevel.

Referring now to FIG. 19, a view showing an angle difference of the micro bevel is shown. There are three angles, angle "R" showing the original chosen angle and would be the angle edges of tools would be sharpened. There is also angle "5", which is the angle of the micro bevel. As well as angle "T" which is the difference of angle "R" minus angle "5". A micro beveled tool provides two main advantages. First, the edge itself would represent a smaller area to hone, thereby saving time and effort. Secondly, the actual cutting edge is slightly less fragile. Nevertheless, a micro beveled edge may slightly increase the amount of force needed to make a cut into a material desired to be shaped.

Figure 20:
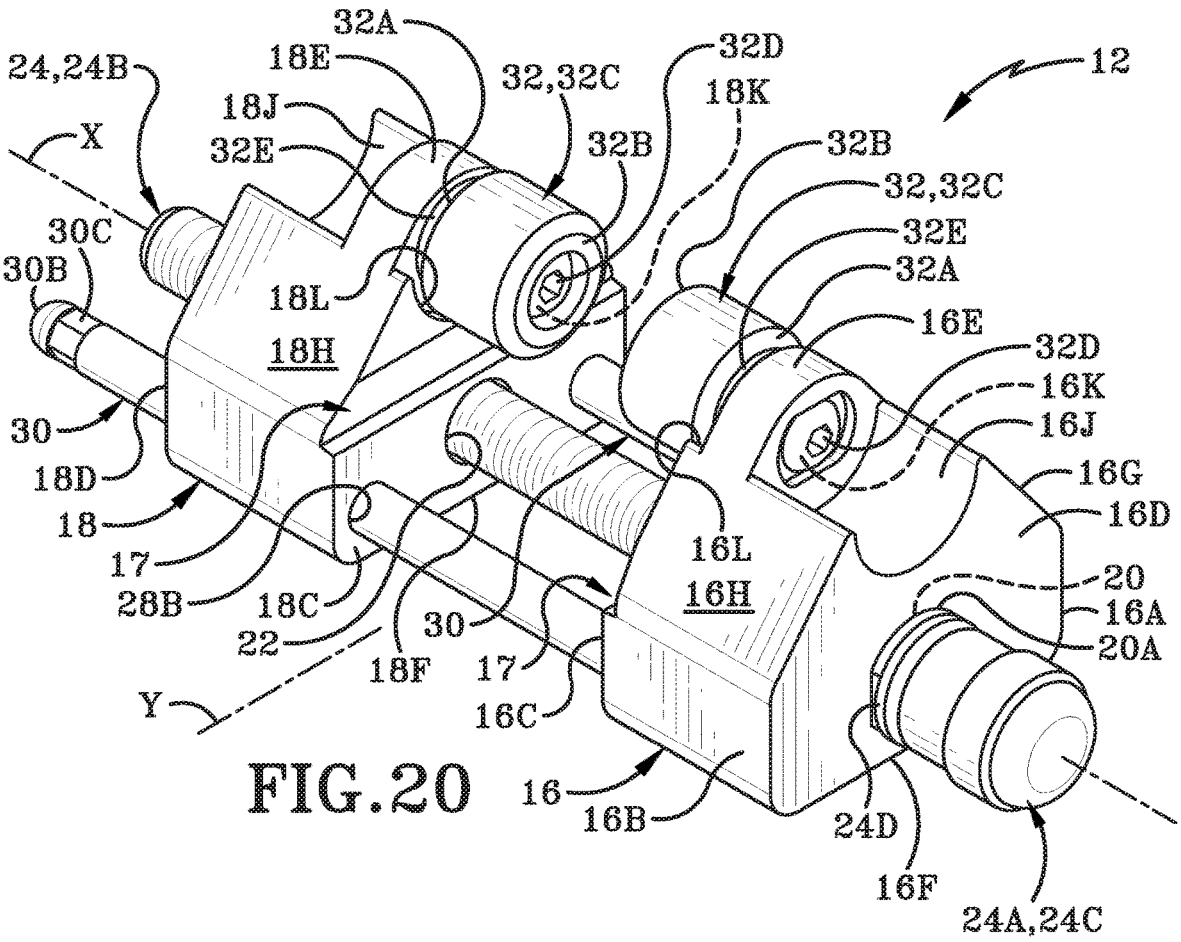
FIG. 20 is a top right side perspective view of an alternative configuration of the sharpening guide.
Figure 21:
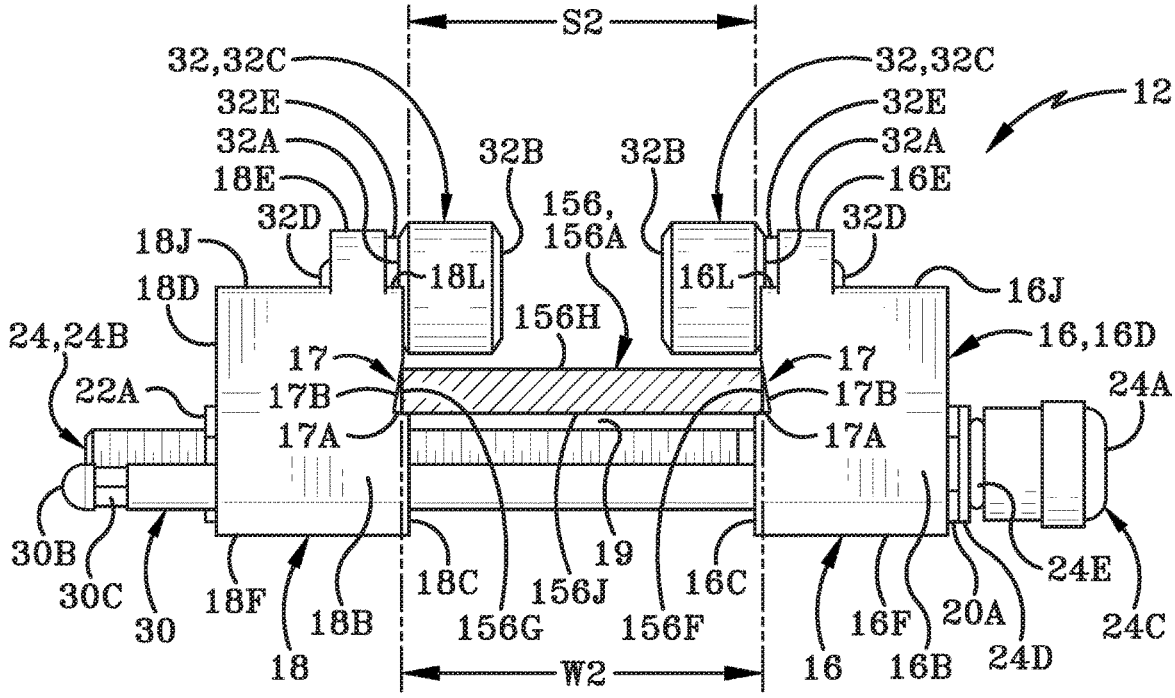
FIG. 21 is a front perspective view of the alternative configuration of the sharpening guide.

Referring now to FIG. 20 and FIG. 21, a top right side perspective view of an alternative configuration of the sharpening guide 12 is shown. In this configuration the wheels 32 are moved from their exterior cavities 16J, 18J to the interior cavities 16L, 18L. In order to do this, one may remove the fasteners 32D and then reinsert the fasteners 32D into their respective apertures 16K, 18K and reengage the wheels 32 with the fasteners 32D. In this configuration the width "W" of an exemplary tool 156 as well as the width of the wheels 32 "U" are shown in FIG. 21. The exemplary tool 156 further has a blade portion 156A, a first side 156F, a second side 156G, a top 156H and a bottom 156J. This configuration of the wheels 32 attached to the inside of the sharpening guide may be useful when any tool desired to be sharpened is a very wide plane iron or other similarly situated tool. When any tool may be very wide, it may not fit on a whetstone or other sharpening apparatus. As such, it may be unwieldy and difficult to sharpen safely. By moving the wheels 32 to the interior of the sharpening guide 12, the exemplary tool 156 may still be supported by two points of contact on the sharpening apparatus. As such, injuries may be reduced and a greater degree of control may be exercised.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0. % of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A system for refining an edge of a tool, the system comprising:

a sharpening guide including a first portion having a first wheel and a second portion having a second wheel, wherein the first portion and the second portion are adapted to retain the tool therebetween;

an angle fixture including a body and a fence coupled to the body, wherein the body defines a track channel and the fence is configured to slide along the body via the track channel;

wherein the body of the angle fixture further comprises:

a front side opposite a rear side;

a first side opposite a second side;

a top side opposite a bottom side;

a stepped ledge extending between the first side and the second side that divides the top side of the body into an upper portion of the top side and a lower portion of the top side;

wherein the track channel is in the upper portion of the top side and extends in a direction from the rear side towards the front side of the body, and wherein the body of the angle fixture further defines a slot below the track channel, wherein the slot defines a central path and the central path is composed of an upper narrow portion bound by first and second ends and a lower wider portion, wherein the slot extends fully through the body from the top side to the bottom side;

at least one angle aperture defined within the upper portion of the top side of the angle fixture;

at least one lock operative to lock the fence relative to the body of the angle fixture after having slid the fence along the track channel to set an angle for the tool that has the edge that is to be refined; and wherein the fence of the angle fixture further comprises:

an index aperture defined in the fence that extends fully through the fence from the top surface to the bottom surface through a projection, wherein the index aperture is aligned with the slot to receive a portion of the at least one lock through the index aperture and slot, and wherein the at least one angle aperture in the body of the angle fixture is offset to one side of the index aperture in the fence.

2. The system of claim 1, wherein the track channel extends centrally between the first side and the second side.

3. The system of claim 1, wherein the sharpening guide further comprises:

an interior side defining a gripping surface on the first portion;

an angled section formed in the gripping surface on the first portion, wherein the angled section is configured to contact a side edge of the tool to be refined.

4. The system of claim 3, wherein the angled section on the first body portion is defined by a top portion that meets the gripping surface of the interior side at an obtuse angle.

5. A system for refining an edge of a tool, the system comprising:

a sharpening guide including a first portion having a first wheel and a second portion having a second wheel, wherein the first portion and the second portion are adapted to retain the tool therebetween;

an angle fixture including a body and a fence coupled to the body, wherein the body defines a track channel and the fence is configured to slide along the body via the track channel;

wherein the fence of the angle fixture further comprises:

a front surface of the fence that is opposite a rear surface of the fence;

a first side of the fence that is opposite a second side of the fence;

a top surface of the fence that is opposite a bottom surface of the fence;

a projection extending downward from the bottom surface of the fence, wherein the projection is shaped complementary to the track channel;

wherein the body of the angle fixture further comprises:

a front side opposite a rear side;

a first side opposite a second side;

a top side opposite a bottom side;

a stepped ledge extending between the first side and the second side that divides the top side of the body into an upper portion of the top side and a lower portion of the top side;

wherein the track channel is in the upper portion of the top side and extends in a direction from the rear side towards the front side of the body;

at least one angle aperture defined within the upper portion of the top side of the angle fixture;

at least one lock operative to lock the fence relative to the body of the angle fixture after having slid the fence along the track channel to set an angle for the tool that has the edge that is to be refined; and wherein the fence of the angle fixture further comprises:

at least three apertures defined in the fence that extend fully through the fence from the top surface to the bottom surface, wherein one of the at least three apertures is an index aperture that extends through the projection, wherein the index aperture is aligned with a slot located below the track channel to receive a portion of the at least one lock through the index aperture and slot.

6. The system of claim 5, wherein the first side of the fence is disposed directly above the first side of the angle fixture.

7. The system of claim 5, wherein the second side of the fence is disposed directly above the second side of the angle fixture.

8. The system of claim 5, wherein the body of the fence spans the body of the angle fixture from the first side to the second side to dispose the first side of the fence directly above the first side of the angle fixture and to dispose the second side of the fence directly above the first side of the angle fixture.

9. The system of claim 5, wherein the fence of the angle fixture further comprises:

a stop surface formed from a different material than the body of the fence, wherein the stop surface is releasably connected to body of the fence.

10. The system of claim 9, wherein the stop surface covers a portion of the front surface of the front surface of the fence.

11. The system of claim 9, wherein the stop surface has ends that terminate short of the first side of the fence and short of the second side of the fence.

12. The system of claim 9, wherein the stop surface is sized to contact the edge of the tool entirely when the tool is retained in the sharpening guide.

* * * * *